US011497260B2

(12) United States Patent
Judson et al.

(10) Patent No.: US 11,497,260 B2
(45) Date of Patent: Nov. 15, 2022

(54) PERSONAL RESPIRATORY PROTECTION DEVICE AND METHOD OF MANUFACTURING A PERSONAL RESPIRATORY PROTECTION DEVICE

(71) Applicant: JSP LIMITED, Witney (GB)

(72) Inventors: Matthew Judson, Witney (GB); Clive Johnstone, Witney (GB)

(73) Assignee: JSP LIMITED, Witney (GB)

( * ) Notice: Subject to any disclaimer, the term of this patent is extended or adjusted under 35 U.S.C. 154(b) by 163 days.

(21) Appl. No.: 16/753,767

(22) PCT Filed: Oct. 1, 2018

(86) PCT No.: PCT/GB2018/052793
§ 371 (c)(1),
(2) Date: Apr. 4, 2020

(87) PCT Pub. No.: WO2019/069061
PCT Pub. Date: Apr. 11, 2019

(65) Prior Publication Data

US 2020/0268072 A1 Aug. 27, 2020

(30) Foreign Application Priority Data

Oct. 6, 2017 (GB) ..... 1716386

(51) Int. Cl.
*A41D 13/11* (2006.01)
*A62B 23/02* (2006.01)

(52) U.S. Cl.
CPC ..... *A41D 13/1138* (2013.01); *A62B 23/025* (2013.01); *A41D 2400/42* (2013.01)

(58) Field of Classification Search
CPC ..... A41D 13/11–1192; A41D 2400/42; A62B 7/10; A62B 9/02; A62B 9/04;
(Continued)

(56) References Cited

U.S. PATENT DOCUMENTS 3,985,132 A 10/1976 Boyce et al.
2003/0192546 A1 10/2003 Bostock et al.
(Continued)

FOREIGN PATENT DOCUMENTS

WO 2010001288 A2 1/2010
WO 2016/182989 A1 11/2016
WO 2017/208260 A1 12/2017

OTHER PUBLICATIONS https://en-gb.facebook.com/JSPLtd/ Published: Oct. 5, 2017 Accessed: Mar. 27, 2018.

(Continued)

*Primary Examiner* — Rachel T Sippel
(74) *Attorney, Agent, or Firm* — Faegre Drinker Biddie & Reath LLP

(57) ABSTRACT

A fold flat personal respiratory device comprising: a generally planar central panel (10) including a layer of filter media and having opposing first and second side edges (12*a*, 12*b*) and first and second end edges (11); a first side panel joined to said central panel (10) along said first side edge (12*a*); a second side panel joined to said central panel (10) along said second side edge (12*b*); the device being manually configurable from a folded configuration in which said side panels (12*a*, 12*b*) are substantially parallel to a planar surface of said central panel (10) and an operational configuration in which said central (10) and first and second side panels (12*a*, 12*b*) form a cup-shaped respiratory chamber; the device further comprising a rigid or semi-rigid endoskeleton member (36) mounted along a planar surface of said central panel (10) and extending between said first and second side edges (12*a*, 12*b*) and/or said first and second end edges (11).

11 Claims, 12 Drawing Sheets

(58) Field of Classification Search
CPC ..... A62B 18/00; A62B 18/02; A62B 18/08; A62B 18/088–10; A62B 23/00–025; A61M 16/06
See application file for complete search history.

(56) References Cited

U.S. PATENT DOCUMENTS

| | | | | |
|---|---|---|---|---|
| 2004/0255946 | A1 | 12/2004 | Gerson et al. | |
| 2008/0271737 | A1 | 11/2008 | Facer et al. | |
| 2017/0258150 | A1 | 9/2017 | May et al. | |
| 2018/0353782 | A1* | 12/2018 | Vasiliev | A62B 18/10 |
| 2018/0368492 | A1* | 12/2018 | Qu | A41D 13/1176 |
| 2018/0368494 | A1* | 12/2018 | Henderson | A41D 13/1115 |
| 2019/0076680 | A1* | 3/2019 | Liu | A62B 9/04 |
| 2020/0113256 | A1* | 4/2020 | Wagner | A41D 13/1161 |

OTHER PUBLICATIONS

International Search Report and Written Opinion received for PCT Patent Application No. PCT/GB2018/052793, dated Jan. 4, 2019, 9 pages.
Springfit, "Integrated Structural Comfort", 1 page available at https://www.jsp.co.uk/link/en/springfit/e/ Accessed Mar. 27, 2018.

* cited by examiner

PERSONAL RESPIRATORY PROTECTION DEVICE AND METHOD OF MANUFACTURING A PERSONAL RESPIRATORY PROTECTION DEVICE

CROSS-REFERENCE TO RELATED APPLICATION

This application is a U.S. 371 National Stage Application of International Application No. PCT/GB2018/052793, filed Oct. 1, 2018, which claims the benefit of Great Britain Application No. GB1716386.6, filed Oct. 6, 2017, both of which are herein incorporated by reference in their entireties.

FIELD OF THE INVENTION

This invention relates generally to personal respiratory protection devices and, more particularly, to a personal respiratory protection device configured to fold flat for storage or transport and form a respiratory air chamber over a wearer's nose and mouth, in use, and a method of manufacturing such a device.

BACKGROUND OF THE INVENTION

Personal respiratory devices, otherwise known as face masks, are used in a wide variety of applications to protect a wearer's respiratory system from particles suspended in the air or from unpleasant or noxious gases. Face masks are typically designed to be worn over a user's nose and mouth to protect them from undesirable material suspended in the air. Generally, these types of face mask come in two basic designs, namely a molded cup-shaped form or a flat-folded form.

In many applications, it is particularly desirable to provide such a face mask having a generally "flat" configuration for easy storage, e.g. in a user's pocket, prior to use. International (PCT) Patent Application no. PCT/US96/03088 describes a flat-folded personal respiratory protection device that is formed in three parts. A first elliptical panel is provided having opposing side edges. This panel covers the user's nose and mouth in use. A second elliptical panel is welded along one of the side edges (and spans the bridge of a user's nose, in use). A third elliptical panel is welded along the other side edge and covers the user's chin, in use. Thus, the three parts together form a face mask that folds flat about the welded side edges and can be opened into a convex configuration for use. At least the first elliptical panel comprises a web assembly consisting of an inner cover web layer, a foam layer, a layer of filter media, a reinforcing or stiffening layer or scrim and an outer web layer, the layers being held together by thermal bonding or adhesive, for example. This layered web assembly, together with the rigid welds holding the panels together, are essential in the described device, to ensure that the front panel (that covers the user's nose and mouth) retains its structure and is prevented from crumpling during prolonged use. An exhalation valve may be mounted within the front panel for some applications.

Such "fold flat" masks are generally well known in the industry, with the natural space saving and low weight benefits, providing a quick and easy form of respiratory protection, and the ability to carry them easily in clothing pockets between uses, or hang them around a user's neck. For manufacturers, there are significant economies of scale in volume production, which carries through to the end-user pricing. Thus, fold flat masks are considered an inexpensive, high voluminous and 'disposable' option to satisfy the need for protection in low-to-medium grade contaminated environments, without needing more advanced moulded half-mask or full-face masks.

Whilst face masks of the above-described structure have been in widespread use for a number of years, there are numerous issues associated with them. In order to ensure that the device retains its structure during use, and as the user breathes in and out repeatedly, it is necessary for at least the main panel to comprise five layers of material, including a reinforcing or stiffening layer or scrim. The resultant thickness of the panel and the associated stiff welds between the panels, may cause the user some discomfort, especially during prolonged use, and the breathing resistance is relatively high, potentially causing further discomfort. Even with the reinforcing or stiffening layer or scrim, the structure of the device, when in use, is still relatively easily compromised, as is its durability, leading to inward leakage that may place the user in danger of inadvertently inhaling particulate or gaseous substances from the surrounding air.

Furthermore, the three-part construction and rigid welds required to manufacture the product is relatively complex and prone to quality issues.

Thus, it would be desirable to provide an improved fold-flat personal respiratory device that addresses at least some of these issues, and provides improved user comfort, reduced weight, reduced breathing resistance, improved filtration, lower cost and/or improved inward leakage prevention. It would also be desirable to provide an improved method of manufacturing such a device.

SUMMARY OF THE INVENTION

In accordance with a first aspect of the present invention, there is provided a fold-flat personal respiratory device comprising:

- a generally planar central panel including a layer of filter media and having opposing first and second side edges and first and second end edges;
- a first side panel joined to said central panel along said first side edge;
- a second side panel joined to said central panel along said second side edge;
- the device being manually configurable from a folded configuration in which said side panels are substantially parallel to a planar surface of said central panel and an operational configuration in which said central and first and second side panels form a cup-shaped respiratory chamber;
- the device further comprising a rigid or semi-rigid endoskeleton member mounted along a planar surface of said central panel and extending between said first and second end edges and/or between said first and second end edges.

The endoskeleton member provides an internal frame structure which acts to optimise the tension supporting the central or 'front' panel to hold the panel firm with a maximised flat surface area when the mask is fitted to a user's face. The improved structure of the mask ensures that the front panel is held away from direct contact with the user's nose and mouth, even with prolonged or repeated use, to avoid irritation, discomfort and interference with the performance of the mask. It is possible to eliminate the conventional 'stiffened' fibrous layer of material, thus enabling the use of softer and (individually) thinner material grades that are more comfortable and can be 'sandwiched' into a formation that offers better filtration performance than prior art devices. The endoskeleton member takes up the provision of structural integrity, providing a more cost effective solution.

In addition, the optimised tension, maximised flat surface area of the central panel and, indeed, the positioning of that panel can provide significant improvement in filtration performance and reduction in breathing resistance.

The endoskeleton member may, beneficially, be formed of semi-rigid plastics material. In an exemplary embodiment, the endoskeleton member may comprise first and second elongate longitudinal arm portions that extend from a central region of the central panel to a position at or adjacent to respective end edges thereof. Alternatively or in addition, the endoskeleton member may comprise first and second transverse arm portions that extend from a central region of the central panel to respective side edges thereof. In a preferred embodiment, the first and second elongate longitudinal arm portions may each comprise a generally triangular frame member comprising a pair of arms spaced apart at said central region and meeting at an apex at or adjacent to a respective end edge. Optionally, the apex is rounded. The first and second transverse arm portions may each comprise a generally square or rectangular frame member having a pair of substantially parallel, spaced-apart end arms and a distal side arm extending therebetween, said end arms extending transversely from said central region such that said side arm is at, or adjacent to, and substantially parallel to, a respective side edge of said central panel.

The endoskeleton member may further comprise a central frame portion comprising a generally square or rectangular frame member, located at said central region of said central panel, and from which said first and second elongate longitudinal arm portions and/or said first and second transverse arm portions extend.

In some exemplary embodiments of the present invention, the fold-flat mask may further comprise an exhalation valve assembly mounted within said endoskeleton, at a substantially central region of said central panel. In an exemplary embodiment, the central frame portion of the endoskeleton member may include a generally cylindrical frame member mounted or integrated in said central frame portion and configured to receive an exhalation valve assembly.

In other exemplary embodiments, particularly those that do not include an exhalation valve assembly, the central frame portion of the endoskeleton member may be provided with a reinforcing member that extends between a pair of opposing side edges thereof. The reinforcing member may comprise a pair of reinforcing arms, each extending between a respective pair of opposing side edges and intersecting at a generally central location within the central frame portion.

In accordance with another aspect of the present invention, there is provided a method of manufacturing a fold-flat respiratory device substantially as described above, comprising: providing an integrated template comprising said central panel and said first and second side panels; and mounting or adhering said endoskeleton member onto a planar surface of said central panel such that it extends between said first and second end edges and/or said first and second side edges thereof.

The central panel may comprise a generally square or rectangular central region defining said first and second opposing side edges and a pair of respective end portions extending from said central region, each end portion having tapered opposing side edges and terminating at a respective end edge of said central panel, each side panel being integrally joined to said central panel along a respective side edge thereof and having a pair of tapered end portions, the method further comprising joining, at adjacent edges thereof, respective end portions of said central panel and said side panels to form said cup-shaped respiratory chamber.

The endoskeleton member may, optionally, comprise an exhalation valve frame member and the central panel includes a generally central opening, the method further comprising mounting an exhalation valve assembly in said exhalation valve frame member such that it is located within said opening.

The method may further comprise joining one or more straps to said central panel, at or adjacent respective end edges thereof.

These and other aspects of the present invention will become apparent from the following specific description.

DETAILED DESCRIPTION

Figure 1:
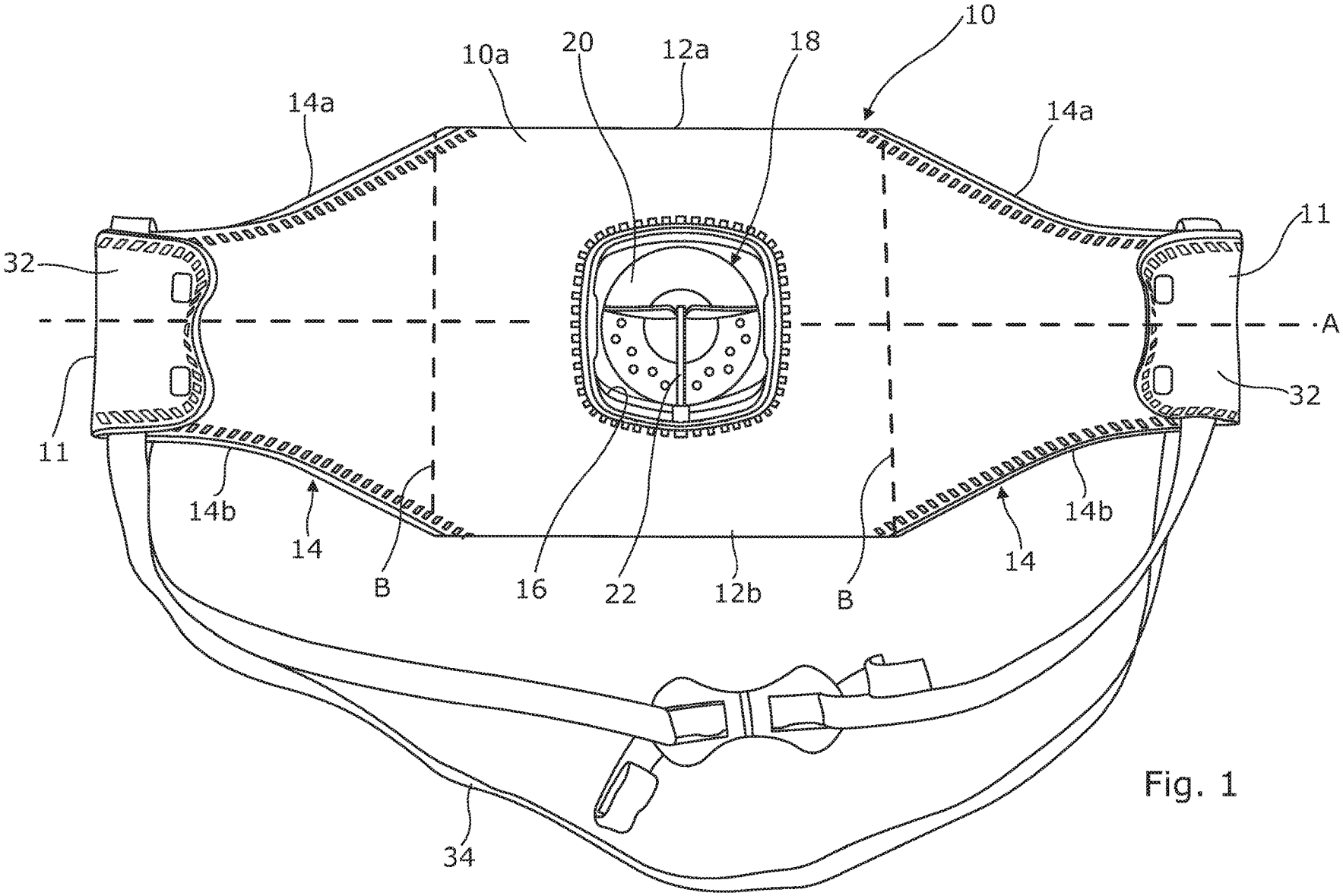
FIG. 1 is a schematic plan view of a personal respiratory device according to a first exemplary embodiment of the present invention, in the folded configuration.
Figure 2:
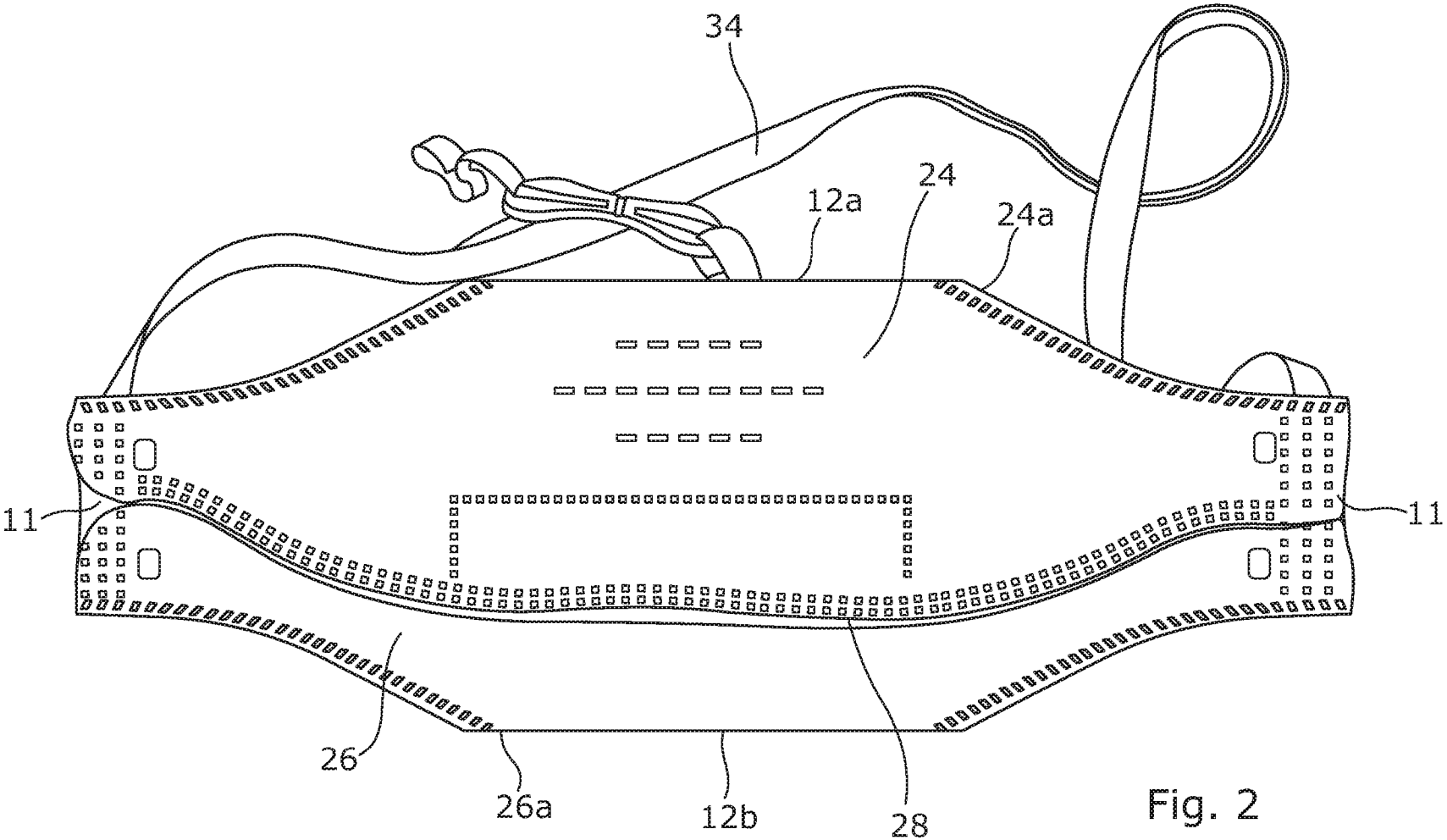
FIG. 2 is a schematic bottom view of the personal respiratory device of FIG. 1.

Referring to FIGS. 1 and 2 of the drawings, a personal respiratory device according to a first exemplary embodiment of the present invention is illustrated in a folded ('fold-flat') configuration for storage in a package prior to use or in a wearer's pocket. The device comprises a generally planar elongate central panel 10 defining a longitudinal axis A extending between a pair of opposing end edges 11. The central panel 10 is formed of or at least includes a flexible filter media layer and (optionally) and outer protective cover or coating. The central portion 10*a* of the central panel 10 is generally square or rectangular in shape having substantially parallel 'upper' and 'lower' linear side edges 12*a*, 12*b*, wherein the terms 'upper' and 'lower' are simply used to denote the relative location of the side edges relative to each other when the device is oriented for, and in, normal use. The distance between each end of the 'upper' side edge 12*a* and each corresponding end of the 'lower' side edge 12*b* defines a first lateral dimension B of a first length.

The end edges 11 are substantially parallel to, and longitudinally spaced apart from, a respective lateral dimension B, and of a second length that is less than the above-mentioned first length. The central panel 10 comprises a pair of side portions 14, each extending between a respective later dimension B and the nearest end edge 11 thereto. Each side portion 14 comprises an 'upper' edge 14*a* that tapers or curves from an end of the 'upper' linear side edge 12*a* to the top of the nearest end edge 11, and a 'lower' edge 14*b* that tapers or curves from an end of the 'lower' linear side edge 12*b* to the bottom of the nearest end edge 11. Thus, in this exemplary embodiment, the central panel 10 is generally rectangular with 'cut away' corners or can alternatively be described as being of an elongated octagonal shape that is substantially symmetrical about the longitudinal axis A. However, it is to be understood that the present invention is not necessarily intended to be limited in this regard and the central panel could, alternatively, be rectangular or even elliptical in shape.

The central panel 10 comprises a substantially central aperture 16 which, in this exemplary embodiment, is of generally square shape with slightly rounded corners, although once again the present invention is not necessarily intended to be limited in this regard, and the aperture 16 may be of any suitable shape, dependent (at least in part) on the exhalation valve assembly it is required to accommodate.

An exhalation valve assembly 18 is mounted and secured within the aperture 16. Exhalation valve assemblies suitable for use in a fold-flat personal respirator device of this type will be well known to a person skilled in the art. Many different types and configurations of such assemblies exist, and the present invention is not necessarily intended to be limited in this regard. However, in this particular exemplary embodiment of the present invention, the exhalation valve assembly 18 comprises a circular, flexible diaphragm 20 mounted within a frame at the rear of the central panel 10 (to be described hereinafter) and covered with a rigid cage or housing 22, that protrudes slightly from the front of the central panel 10 and has breathing apertures or openings (not shown) in its side edges.

Referring particularly to FIG. 2 of the drawings, the device further comprises first and second elongate side panels 24, 26. A first side panel 24 has an adjoining longitudinal edge 24*a* having a profile that substantially matches the profile of the 'upper' edge of the central panel 10 defined by the upper edges 14*a* of the side portions 14 and the upper side edge 12*a* as described hereinbefore. The adjoining edge 24*a* of the first side panel 24 is joined along the upper edge (as defined above) of the central panel 10, as will be described in more detail hereinafter. The second side panel 26 has an adjoining longitudinal edge 26*a* having a profile that substantially matches the profile of the 'lower' edge of the central panel 10 defined by the 'lower' edges 14*b* of the side portions 14 and the lower side edge 12*b* as described hereinbefore. The adjoining edge 26*a* of the second side panel 26 is joined along the lower edge (as defined above) of the central panel 10, as will be described in more detail hereinafter. The ends of the first and second side panels 24, 26 are joined to the end edges 11 of the central panel 10.

As illustrated in FIG. 2 of the drawings, in the folded configuration, the second side panel 26 extends from the lower edge of the central panel 10 and lies substantially parallel to, and adjacent, the rear surface of the central panel 10. The first side panel 24 extends from the upper edge of the central panel 10 and lies substantially parallel, and adjacent, to the rear surface of the central panel 10, with the 'free' edge 28 thereof (i.e. the opposing longitudinal edge to the respective adjoining edge 24*a*) overlapping the free edge (30, but not shown in FIG. 2) of the second side panel 26 to form a generally flat structure.

Referring back to FIG. 1 of the drawings, a mounting flap 32 is provided at each end edge 11 of the central panel 10. Each mounting flap 32 comprises a generally rectangular piece of flexible material (e.g. fabric) having opposing end edges, wherein a first end edge is securely joined between the respective end edge 11 of the central panel and the associated end edges of the side panels 24, 26. The second end edge of each mounting flap 32 is folded over the respective end edge 11 of the central panel 10 and securely joined to the front face thereof (in the region of the respective side portion 14) to form a loop at each end of the device. An adjustable (and/or elasticated) head strap 34 is mounted within these loops.

Figure 3A:
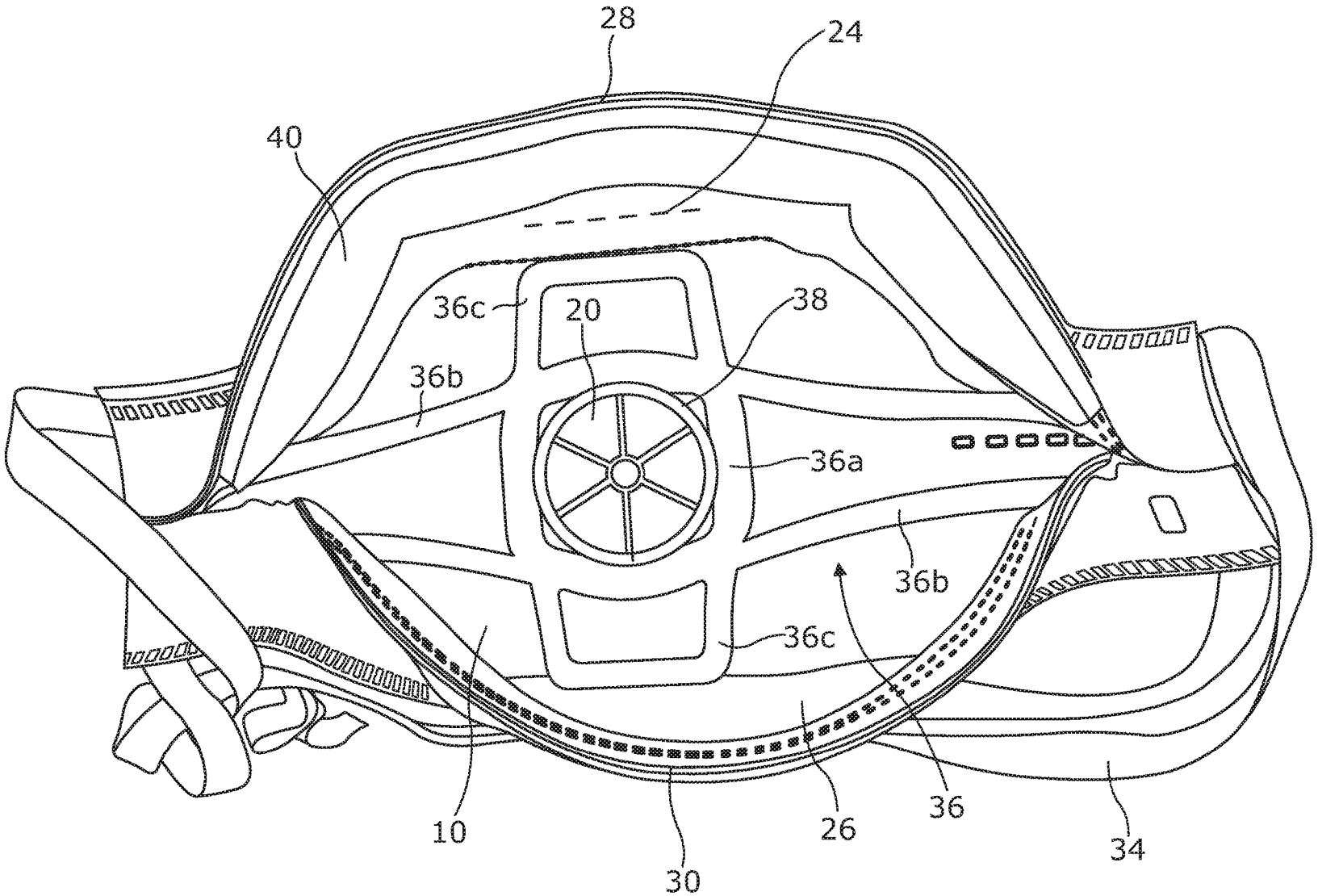
FIG. 3*a* is a schematic rear perspective view of the personal respiratory device of FIG. 1, in the operable configuration.
Figure 3B:
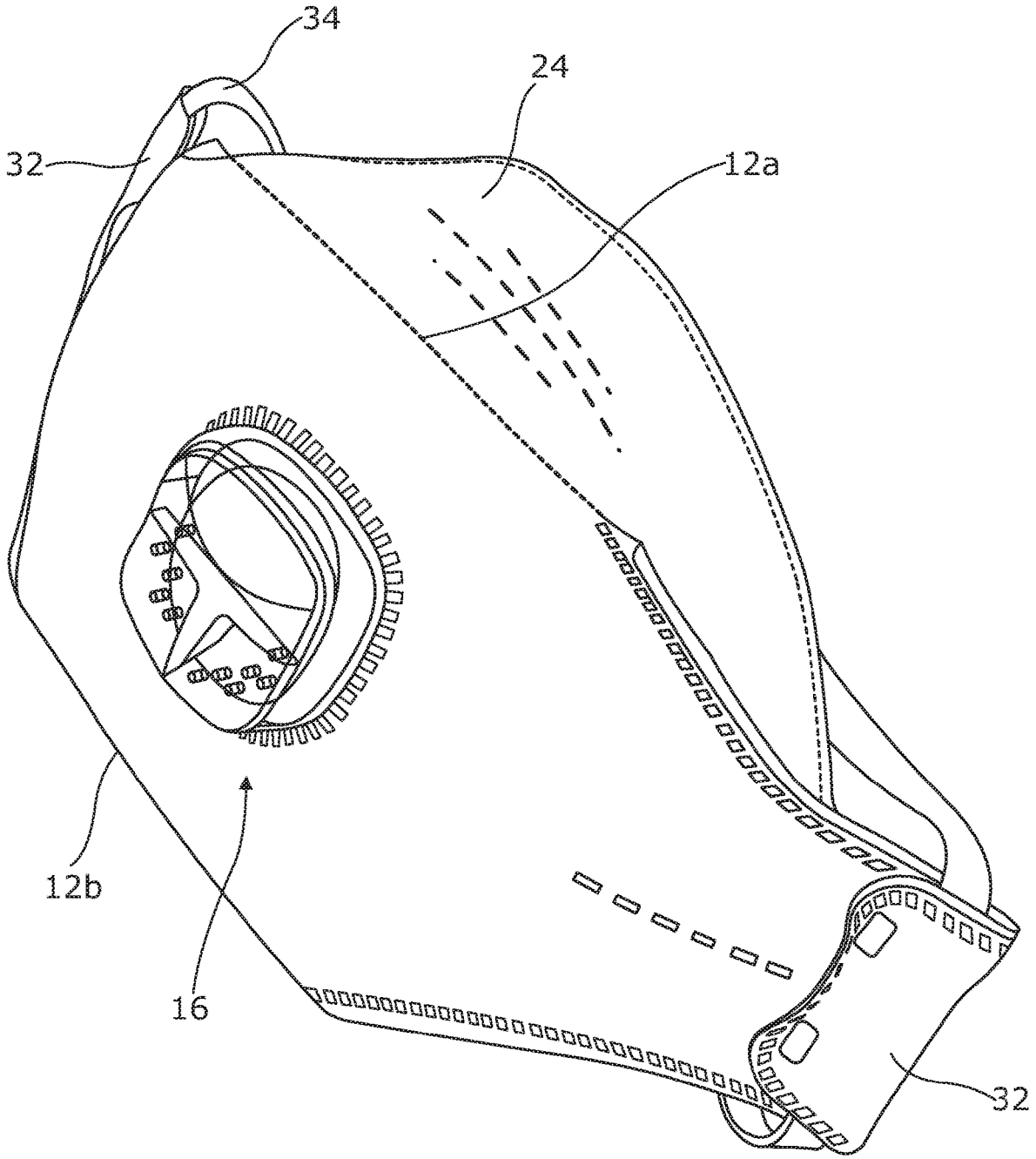
FIG. 3*b* is a schematic front perspective view of the personal respiratory device of FIG. 3*a;*

Referring now to FIGS. 3*a* and 3*b* of the drawings, the device is reconfigurable from the folded configuration to an operable configuration, in which it defines a cup-shaped respiratory device. This reconfiguration may be achieved, in use, by, for example, manually separating the free edges 28, 30 of the side panels 24, 26 or by pushing the two end edges 11 toward each other to cause the free edges 28, 30 of the side panels 24, 26 to separate the free edges 28, 30 of the side panels 24, 26. In the operable configuration, the side panels 24, 26 form 'upper' and 'lower' side walls around the central panel 10, thereby defining the cup-shaped respiratory device form that can be placed over a user's nose and mouth, in use, and secured by means of the head strap 34 which passes over their head and may be secured behind their ears.

As can be seen in FIG. 3*a* of the drawings, the 'rear' surface of the central panel 10 (i.e. the surface nearest the user's face when the device is in normal use) has mounted thereon a semi rigid endoskeleton member 36. The endoskeleton member 36 is formed of semi rigid material (i.e. resiliently flexible but sufficiently rigid to hold its form when no external force is applied), e.g. plastic.

Figure 4:
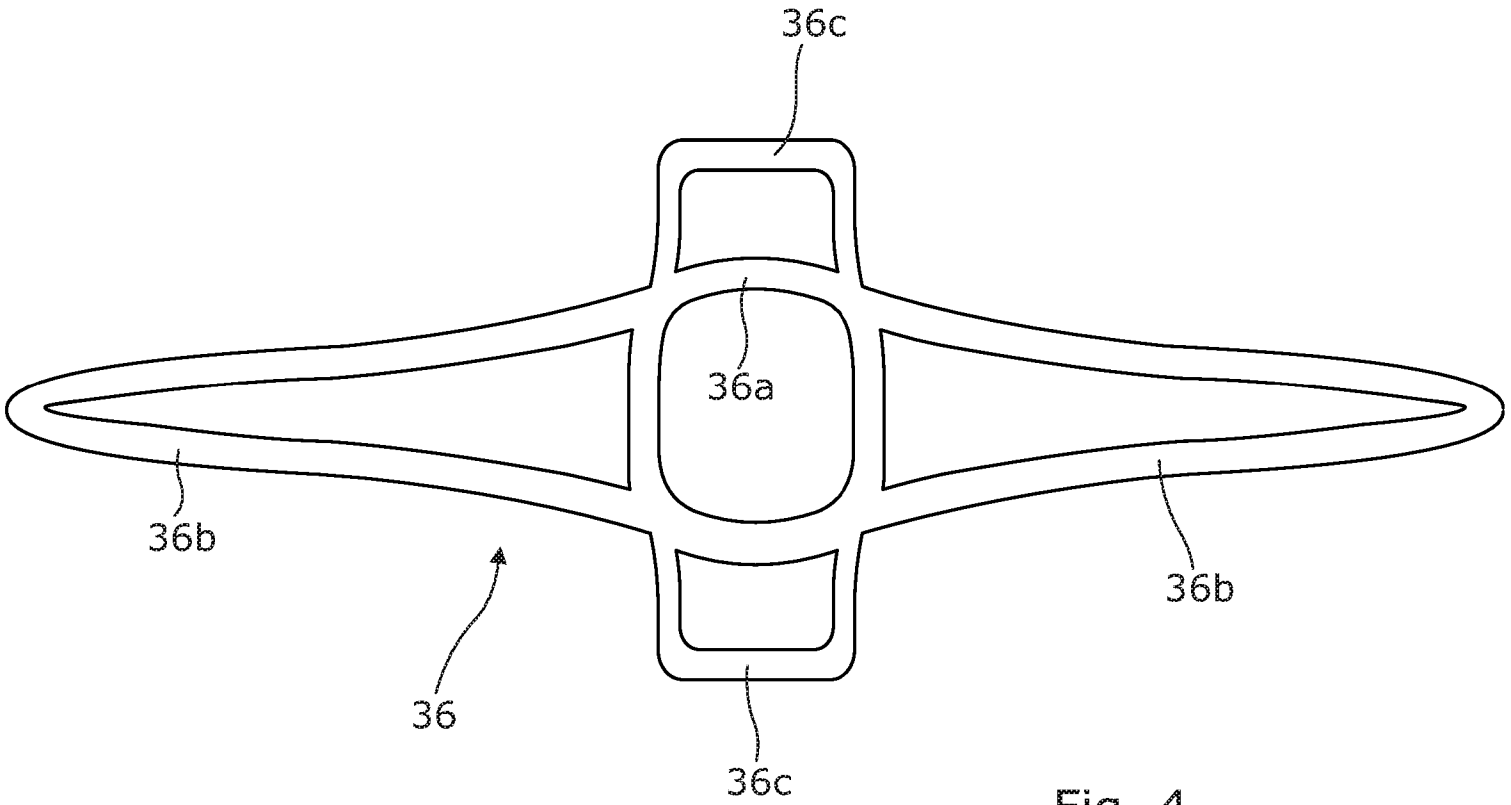
FIG. 4 is a schematic plan view of an endoskeleton member of a personal respiratory device according to a first exemplary embodiment of the present invention.

The shape and configuration of the endoskeleton member 36 for this exemplary embodiment of the present invention can be seen more clearly in FIG. 4 of the drawings. As shown, the member 36 is a generally cross-shaped frame, having a central frame portion 36*a* of generally square shape with slightly rounded corners and defining a like shaped opening that substantially matches the aperture 16 in the central panel 10 of the respiratory device. The central frame member 36*a* comprises a pair of opposing ('upper' and 'lower') side edges and a pair of opposing end edges. When the endoskeleton member 36 is mounted on the central panel, it is oriented such that the upper and lower side edges of the central frame portion 36*a* are generally parallel (respectively) to the upper and lower side edges 12*a*, 12*b* of the central panel and the opposing end edges are substantially parallel to the end edges 11 of the central panel. The endoskeleton member 36 further comprises a pair of elongate arm portions 36*b* defined by a pair of generally triangular frame portions, each having a slightly rounded apex. Each arm portion 36*b* extends from a respective end edge of the central frame portion 36*a* and, when mounted on the central panel 10 of the respiratory device, each arm portion extends from a location adjacent a side edge of the aperture 16 to a location close to or at a respective end edge 11 of the central panel (i.e. the apex of each arm portion is located close to or at a respective end edge 11 of the central panel 10). Finally, the endoskeleton member 36 comprises a pair of extension portions 36*c* in the form of generally rectangular frame portions, each of which extends from a respective side edge of the central frame portion 36*a*. When the endoskeleton member 36 is mounted on the central panel 10, a first rectangular frame portion extends from the upper side edge of the central frame portion 36*a* to the upper side edge 12*a* of the central panel 10 and a second rectangular frame portion extends from the lower side edge of the central frame portion 36*a* to the lower side edge 12*b* of the central panel 10.

Thus, in this exemplary embodiment of the present invention, the endoskeleton member 36 is of a general 'cross' shape, wherein a rhombus-like structure is defined by the central frame portion 36*a* and the arm portions 36*b*, the rhombus like structure having a longitudinal axis defined between the apexes of the arm portions 36*b*, and a transverse axis is defined between the outer edges of the rectangular frame portions 36*c*. It is important to note that the specific form of the endoskeleton member may not necessarily be limited in this regard. It is, of course, desirable to utilise as little material as possible to achieve the desired reinforcing function (thereby to minimise weight and cost), which is why it is considered highly advantageous to use a frame of this type. However, the present invention may not necessarily be limited in this regard. Equally, the specific shape of the endoskeleton member may be varied. The illustrated shape and configuration has been selected for this exemplary embodiment of the present invention to minimise the amount of material used, whilst ensuring the desired reinforcing function by having portions thereof that extend to the end edges 11 and to the side edges 12*a*, 12*b* of the central panel. However, other shapes may be envisaged that would achieve the same effect. What is important here is that the use of the endoskeleton member to prevent the respiratory device from crumpling or collapsing, not only enables the stiffening layer or scrim of prior art devices to be eliminated from the central panel, but also provides significantly enhanced durability and retention of the cup-shaped structure, enabling prolonged use without loss of comfort, with consistently minimal breathing resistance and increased inward leakage prevention. Thus, for example, in some exemplary embodiments, the endoskeleton may comprise just the transverse arm portions 36*c* extending between the side edges 12*a*, 12*b*, or indeed single, strip-like arm portions that extend between the side edges 12*a*, 12*b*. Similarly, in alternative exemplary embodiments, the endoskeleton may comprise just the longitudinal arm portions 36*b* extending between the end edges 11 or, indeed, single, strip-like arm portions that extend between the end edges 11. In yet another exemplary embodiment, the endoskeleton may comprise a pair of elongate, strip-like arm portions, the first extending between the end edges 11, and the second extending between the side edges 12*a*, 12*b*, such that they intersect generally centrally. In this case, the central frame portion 36*a* may be longitudinally elongated, i.e. in a generally rectangular form (optionally with rounded corners) to improve the structural integrity of the endoskeleton.

An additional advantage of embodiments of the present invention is achieved in the manufacturing process. As explained above, prior art such devices must be manufactured in three separate parts that are welded together to form the device. However, embodiments of the present invention can advantageously be formed of a single piece of material (because there is no need to provide the stiffening layer or scrim in the central panel, so all three panels can be made of the same one- or two-layer flexible material comprising a layer of filter media and (optionally) an outer protective covering or coating). This will be described in more detail hereinafter.

Referring back to FIG. 3*a* of the drawings, a generally circular frame member 38 is mounted within (or formed integrally with) the central frame portion 36*a*. The frame member 38 comprises a first ('outer') shallow cylinder having a height that substantially matches the depth of the central frame portion 36*a* and a diameter that is substantially equal to a side edge of the aperture defined by the central frame portion so that it fits precisely therein. The frame member 38 further comprises a second ('inner') shallow cylinder, concentric with the outer cylinder and of substantially the same height but of much smaller diameter. Radial ribs extend from the inner cylinder to the outer cylinder to define the structure of the frame member 38. The flexible diaphragm 20 includes a generally central protrusion by means of which it can be mounted on the frame, by inserting the protrusion into the inner cylinder for retention thereby.

An elongate strip 40 of foam or cushioning material is bonded or adhered along the inner edge of the free edge 28 of the first side panel 24 to provide additional comfort over the bridge of a user's nose, in use.

Figure 5:
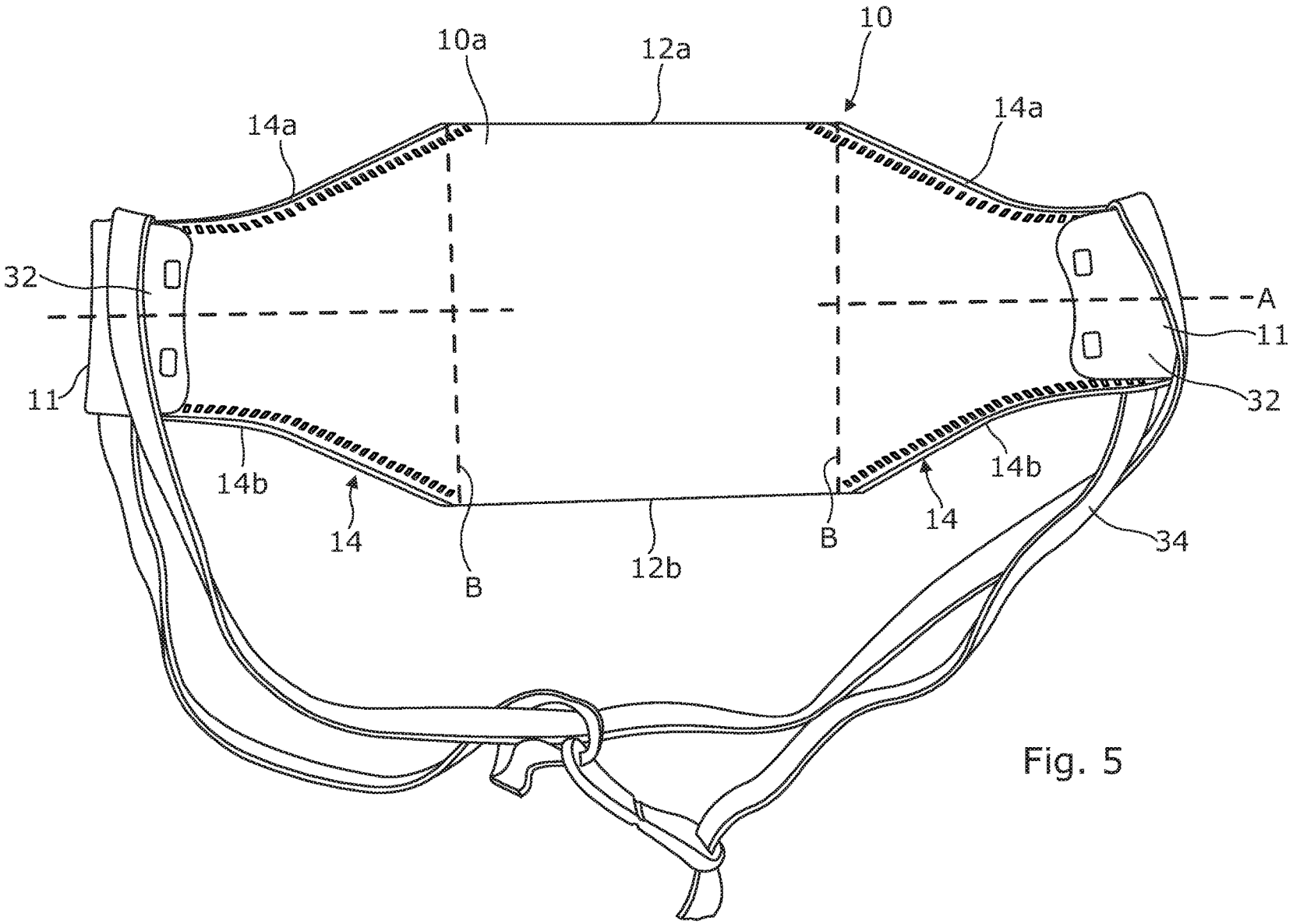
FIG. 5 is a schematic plan view of a personal respiratory device according to a second exemplary embodiment of the present invention, in the folded configuration.
Figure 6:
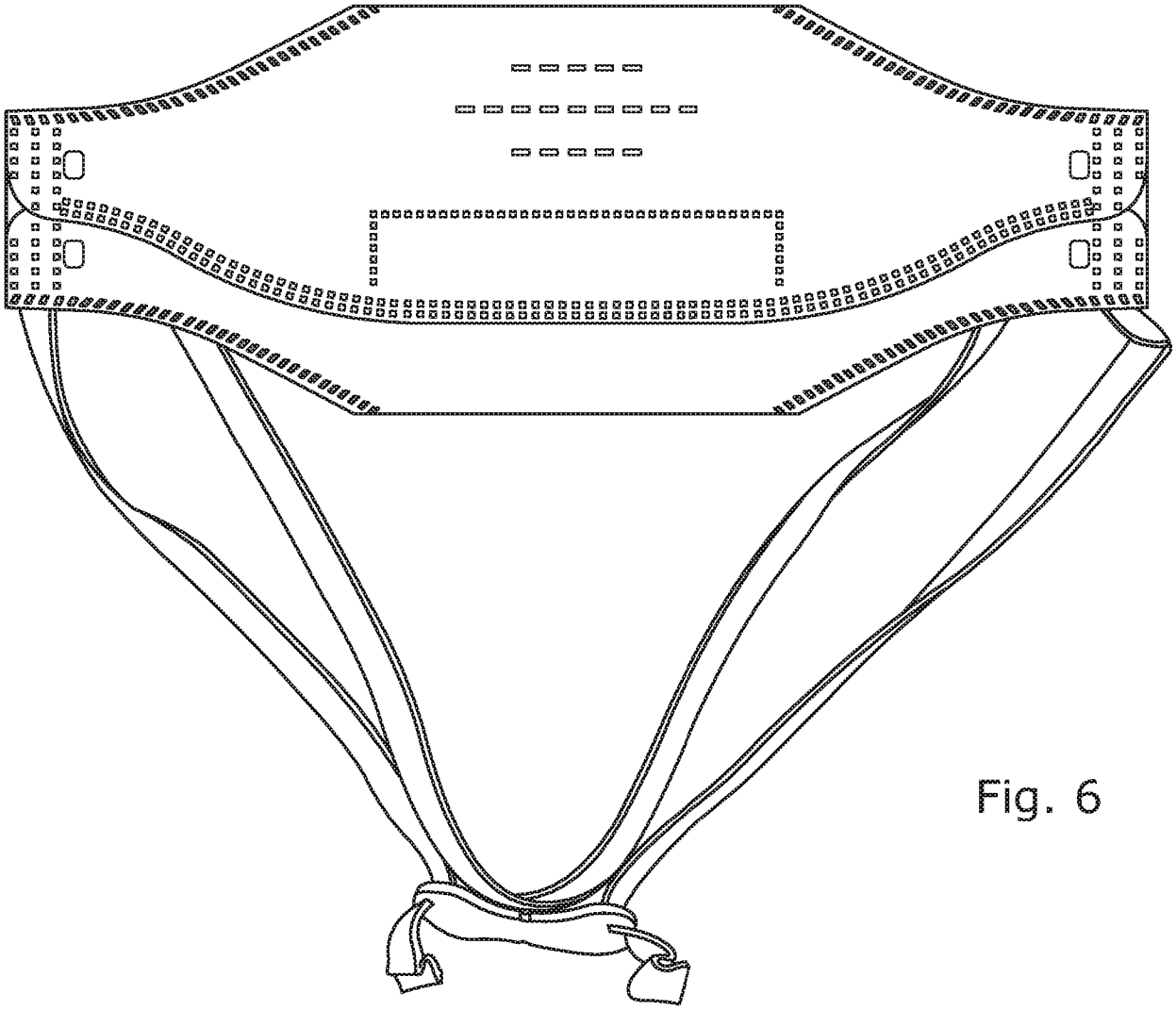
FIG. 6 is a schematic bottom view of the personal respiratory device of FIG. 5.

Referring now to FIGS. 5 and 6 of the drawings, a fold-flat personal respiratory device according to a second exemplary embodiment of the present invention is similar in many respects to that first exemplary embodiment described above, except that no exhalation valve assembly is provided. Like reference numbers are used in FIGS. 5 and 6 to denote the same features described above in relation to the first exemplary embodiment.

Thus, referring to FIGS. 5 and 6 of the drawings, a personal respiratory device according to a second exemplary embodiment of the present invention is illustrated in a folded ('fold-flat') configuration for storage in a package prior to use or in a wearer's pocket. The device comprises a generally planar elongate central panel 10 defining a longitudinal axis A extending between a pair of opposing end edges 11. The central panel 10 is formed of or at least includes a flexible filter media layer and (optionally) and outer protective cover or coating. The central portion 10*a* of the central panel 10 is generally square or rectangular in shape having substantially parallel 'upper' and 'lower' linear side edges 12*a*, 12*b*, wherein the terms 'upper' and 'lower' are simply used to denote the relative location of the side edges relative to each other when the device is oriented for, and in, normal use. The distance between each end of the 'upper' side edge 12*a* and each corresponding end of the 'lower' side edge 12*b* defines a first lateral dimension B of a first length.

The end edges 11 are substantially parallel to, and longitudinally spaced apart from, a respective lateral dimension B, and of a second length that is less than the above-mentioned first length. The central panel 10 comprises a pair of side portions 14, each extending between a respective later dimension B and the nearest end edge 11 thereto. Each side portion 14 comprises an 'upper' edge 14*a* that tapers or curves from an end of the 'upper' linear side edge 12*a* to the top of the nearest end edge 11, and a 'lower' edge 14*b* that tapers or curves from an end of the 'lower' linear side edge 12*b* to the bottom of the nearest end edge 11. Thus, in this exemplary embodiment, the central panel 10 is generally rectangular with 'cut away' corners or can alternatively be described as being of an elongated octagonal shape that is substantially symmetrical about the longitudinal axis A. However, it is to be understood that the present invention is not necessarily intended to be limited in this regard and the central panel could, alternatively, be rectangular or even elliptical in shape.

Referring particularly to FIG. 6 of the drawings, the device further comprises first and second elongate side panels 24, 26. A first side panel 24 has an adjoining longitudinal edge 24*a* having a profile that substantially matches the profile of the 'upper' edge of the central panel 10 defined by the upper edges 14*a* of the side portions 14 and the upper side edge 12*a* as described hereinbefore. The adjoining edge 24*a* of the first side panel 24 is joined along the upper edge (as defined above) of the central panel 10, as will be described in more detail hereinafter. The second side panel 26 has an adjoining longitudinal edge 26*a* having a profile that substantially matches the profile of the 'lower' edge of the central panel 10 defined by the 'lower' edges 14*b* of the side portions 14 and the lower side edge 12*b* as described hereinbefore. The adjoining edge 26*a* of the second side panel 26 is joined along the lower edge (as defined above) of the central panel 10, as will be described in more detail hereinafter. The ends of the first and second side panels 24, 26 are joined to the end edges 11 of the central panel 10.

As illustrated in FIG. 6 of the drawings, in the folded configuration, the second side panel 26 extends from the lower edge of the central panel 10 and lies substantially parallel to, and adjacent, the rear surface of the central panel 10. The first side panel 24 extends from the upper edge of the central panel 10 and lies substantially parallel, and adjacent, to the rear surface of the central panel 10, with the 'free' edge 28 thereof (i.e. the opposing longitudinal edge to the respective adjoining edge 24*a*) overlapping the free edge (30, but not shown in FIG. 2) of the second side panel 26 to form a generally flat structure.

Referring back to FIG. 5 of the drawings, a mounting flap 32 is provided at each end edge 11 of the central panel 10. Each mounting flap 32 comprises a generally rectangular piece of flexible material (e.g. fabric) having opposing end edges, wherein a first end edge is securely joined between the respective end edge 11 of the central panel and the associated end edges of the side panels 24, 26. The second end edge of each mounting flap 32 is folded over the respective end edge 11 of the central panel 10 and securely joined to the front face thereof (in the region of the respective side portion 14) to form a loop at each end of the device. An adjustable (and/or elasticated) head strap 34 is mounted within these loops.

Figure 7A:
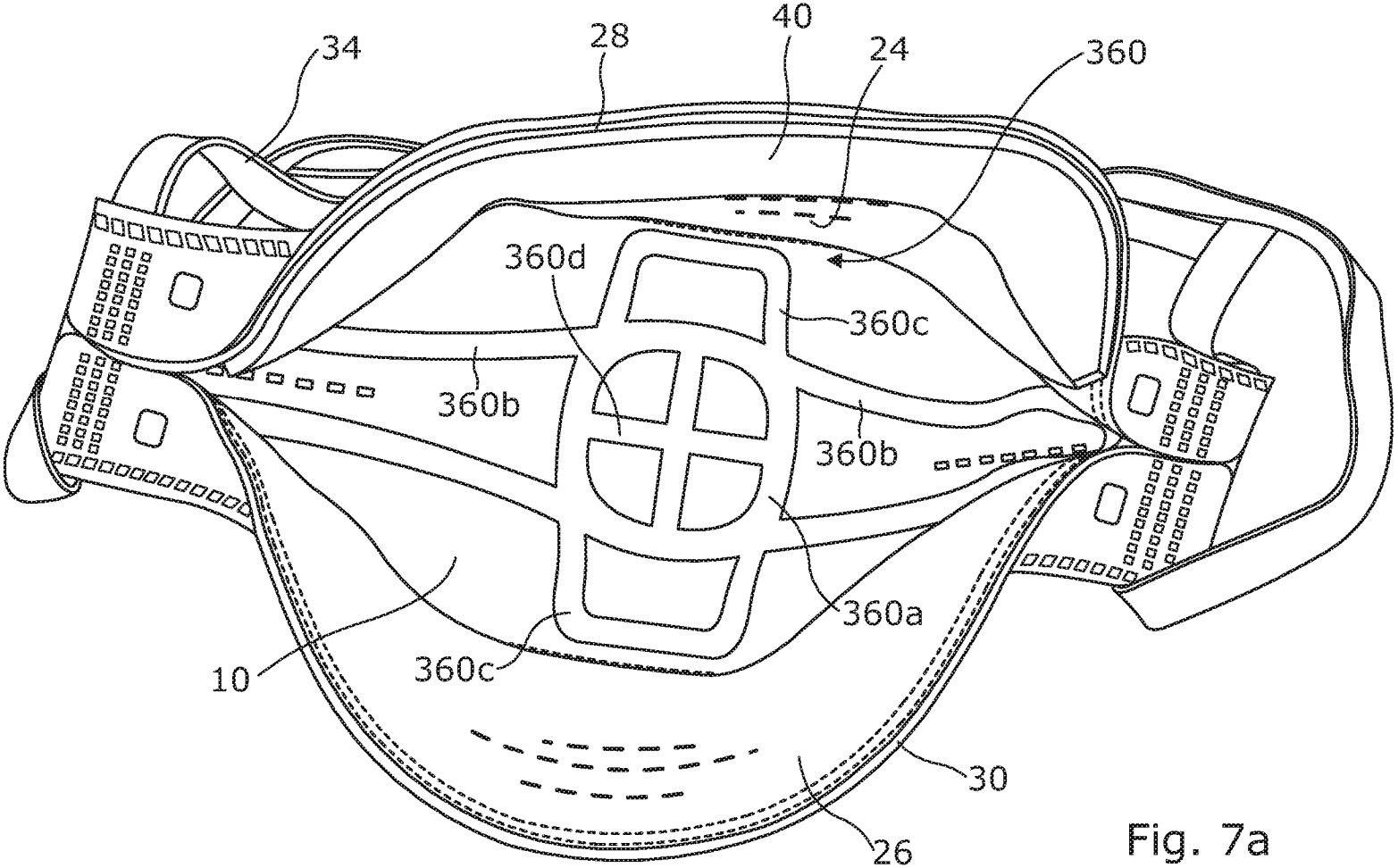
FIG. 7*a* is a schematic rear perspective view of the personal respiratory device of FIG. 5, in the operable configuration.
Figure 7B:
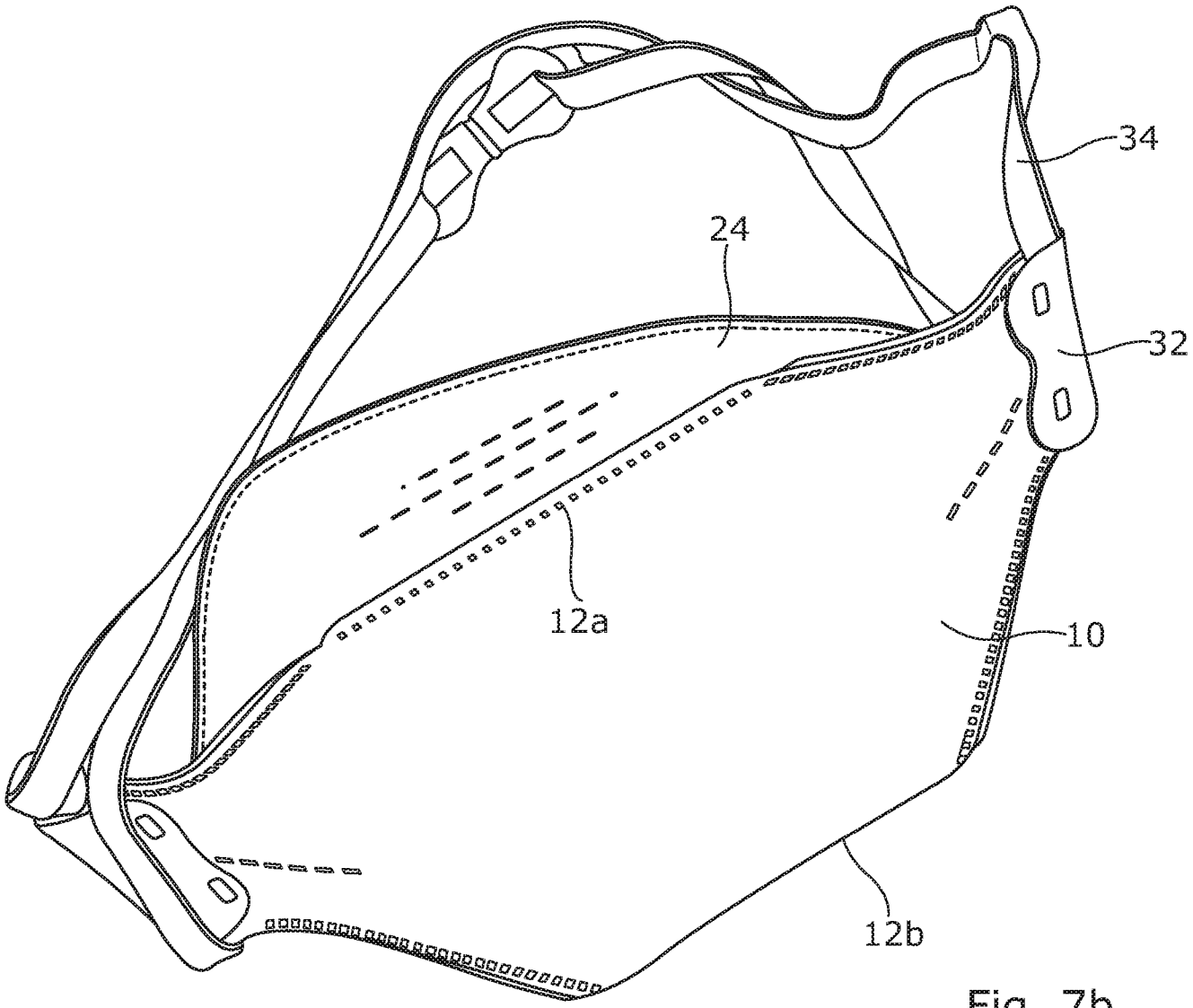
FIG. 7*b* is a schematic front perspective view of the personal respiratory device of FIG. 7*a;*

Referring now to FIGS. 7*a* and 7*b* of the drawings, the device is reconfigurable from the folded configuration to an operable configuration, in which it defines a cup-shaped respiratory device. This reconfiguration may be achieved, in use, by, for example, manually separating the free edges 28, 30 of the side panels 24, 26 or by pushing the two end edges 11 toward each other to cause the free edges 28, 30 of the side panels 24, 26 to separate the free edges 28, 30 of the side panels 24, 26. In the operable configuration, the side panels 24, 26 form 'upper' and 'lower' side walls around the central panel 10, thereby defining the cup-shaped respiratory device form that can be placed over a user's nose and mouth, in use, and secured by means of the head strap 34 which passes over their head and may be secured behind their ears.

Once again, an elongate strip 40 of foam or cushioning material is bonded or adhered along the inner edge of the free edge 28 of the first side panel 24 to provide additional comfort over the bridge of a user's nose, in use.

As can be seen in FIG. 7*a* of the drawings, the 'rear' surface of the central panel 10 (i.e. the surface nearest the user's face when the device is in normal use) has mounted thereon a semi rigid endoskeleton member 360. The endoskeleton member 360 is formed of semi rigid material (i.e. resiliently flexible but sufficiently rigid to hold its form when no external force is applied), e.g. plastic.

Figure 8:
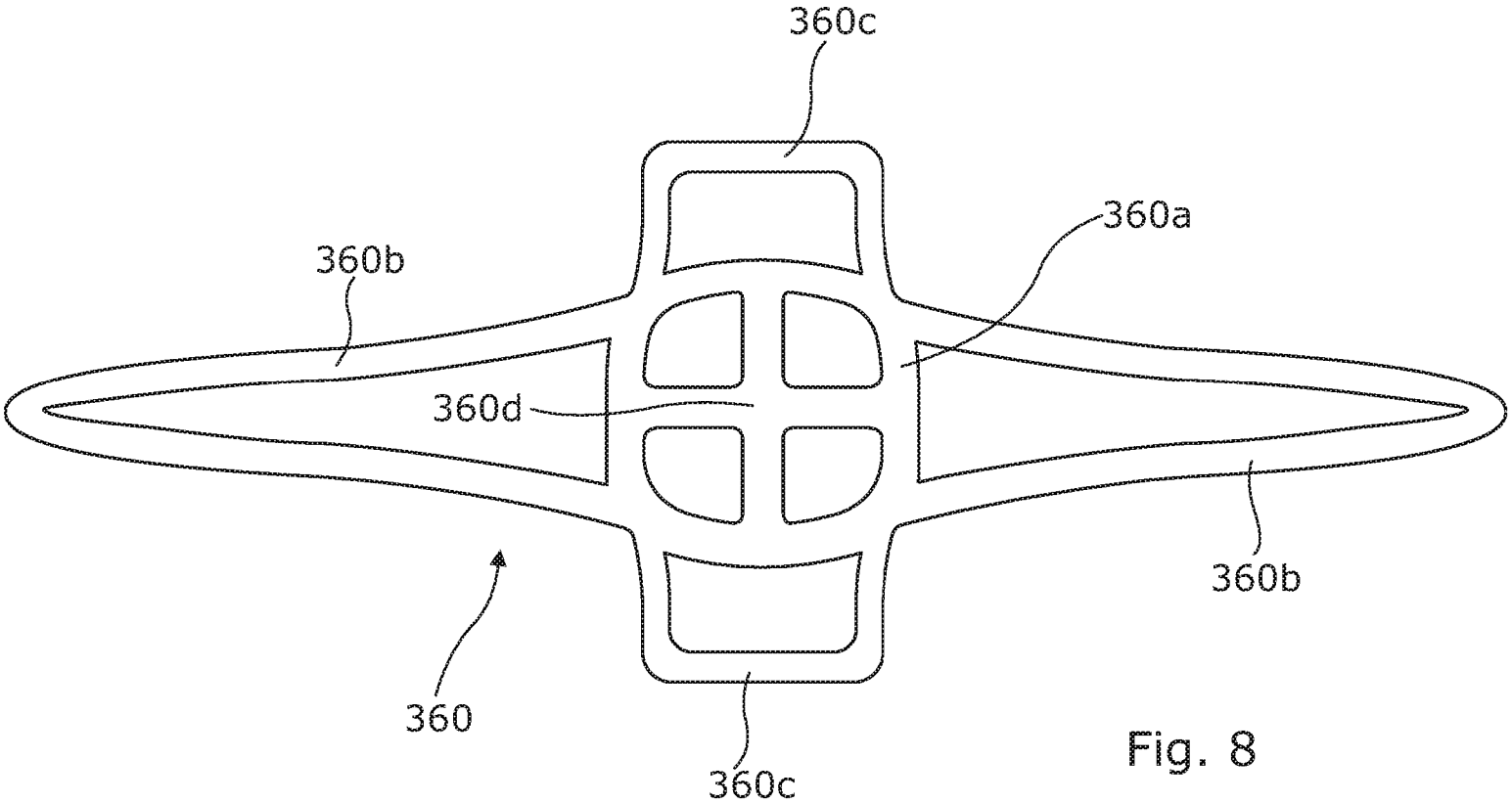
FIG. 8 is a schematic plan view of an endoskeleton member of a personal respiratory device according to a second exemplary embodiment of the present invention.

The shape and configuration of the endoskeleton member 360 for this exemplary embodiment of the present invention can be seen more clearly in FIG. 8 of the drawings. As shown, the member 360 is a generally cross-shaped frame, having a central frame portion 360*a* of generally square shape with slightly rounded corners, as before, but in this case, a cross-shaped reinforcing member 360*d* spans the central opening defined by the central frame member 360*a*. The central frame member 360*a* comprises a pair of opposing ('upper' and 'lower') side edges and a pair of opposing end edges. When the endoskeleton member 360 is mounted on the central panel, it is oriented such that the upper and lower side edges of the central frame portion 360*a* are generally parallel (respectively) to the upper and lower side edges 12*a*, 12*b* of the central panel and the opposing end edges are substantially parallel to the end edges 11 of the central panel. The endoskeleton member 360 further comprises a pair of elongate arm portions 360*b* defined by a pair of generally triangular frame portions, each having a slightly rounded apex. Each arm portion 360*b* extends from a respective end edge of the central frame portion 360*a* and, when mounted on the central panel 10 of the respiratory device, each arm portion extends from a location adjacent a side edge of the aperture 16 to a location close to or at a respective end edge 11 of the central panel (i.e. the apex of each arm portion is located close to or at a respective end edge 11 of the central panel 10). Finally, the endoskeleton member 360 comprises a pair of extension portions 360*c* in the form of generally rectangular frame portions, each of which extends from a respective side edge of the central frame portion 360*a*. When the endoskeleton member 360 is mounted on the central panel 10, a first rectangular frame portion extends from the upper side edge of the central frame portion 360*a* to the upper side edge 12*a* of the central panel 10 and a second rectangular frame portion extends from the lower side edge of the central frame portion 360*a* to the lower side edge 12*b* of the central panel 10.

Thus, in this exemplary embodiment of the present invention, the endoskeleton member 360 is again of a general 'cross' shape, wherein a rhombus-like structure is defined by the central frame portion 360*a* and the arm portions 360*b*, the rhombus like structure having a longitudinal axis defined between the apexes of the arm portions 360*b*, and a transverse axis is defined between the outer edges of the rectangular frame portions 360*c*. It is important to note that the specific form of the endoskeleton member may not necessarily be limited in this regard. It is, of course, desirable to utilise as little material as possible to achieve the desired reinforcing function (thereby to minimise weight and cost), which is why it is considered highly advantageous to use a frame of this type. However, the present invention may not necessarily be limited in this regard. Equally, the specific shape of the endoskeleton member may be varied. The illustrated shape and configuration has been selected for this exemplary embodiment of the present invention to minimise the amount of material used, whilst ensuring the desired reinforcing function by having portions thereof that extend to the end edges 11 and to the side edges 12*a*, 12*b* of the central panel. However, other shapes may be envisaged that would achieve the same effect. What is important here is that the use of the endoskeleton member to prevent the respiratory device from crumpling or collapsing, not only enables the stiffening layer or scrim of prior art devices to be eliminated from the central panel, but also provides significantly enhanced durability and retention of the cup-shaped structure, enabling prolonged use without loss of comfort, with consistently minimal breathing resistance and increased inward leakage prevention. Thus, once again, in some exemplary embodiments, the endoskeleton may comprise just the transverse arm portions 36*c* extending between the side edges 12*a*, 12*b*, or indeed single, strip-like arm portions that extend between the side edges 12*a*, 12*b*. Similarly, in alternative exemplary embodiments, the endoskeleton may comprise just the longitudinal arm portions 36*b* extending between the end edges 11 or, indeed, single, strip-like arm portions that extend between the end edges 11. In yet another exemplary embodiment, the endoskeleton may comprise a pair of elongate, strip-like arm portions, the first extending between the end edges 11, and the second extending between the side edges 12*a*, 12*b*, such that they intersect generally centrally. In this case, the central frame portion 36*a* may be longitudinally elongated, i.e. in a generally rectangular form (optionally with rounded corners) to improve the structural integrity of the endoskeleton.

An additional advantage of embodiments of the present invention is achieved in the manufacturing process. As explained above, prior art such devices must be manufactured in three separate parts that are welded together to form the device. However, embodiments of the present invention can advantageously be formed of a single piece of material (because there is no need to provide the stiffening layer or scrim in the central panel, so all three panels can be made of the same one- or two-layer flexible material comprising a layer of filter media and (optionally) an outer protective covering or coating), as will now be described in more detail.

Figure 9:
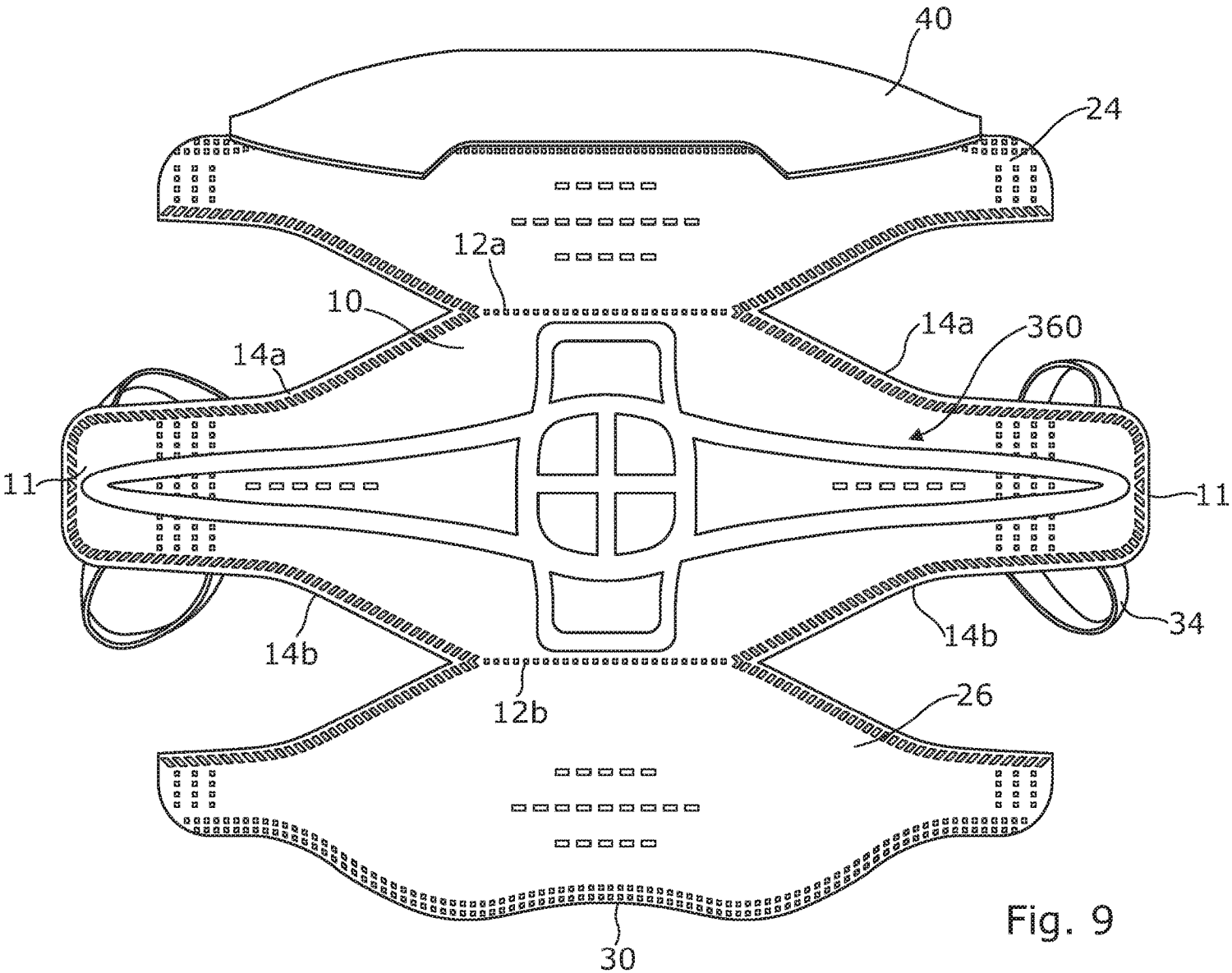
FIG. 9 is a schematic plan view of a first side of a template for manufacturing a personal respiratory device according to a second exemplary embodiment of the present invention.
Figure 10:
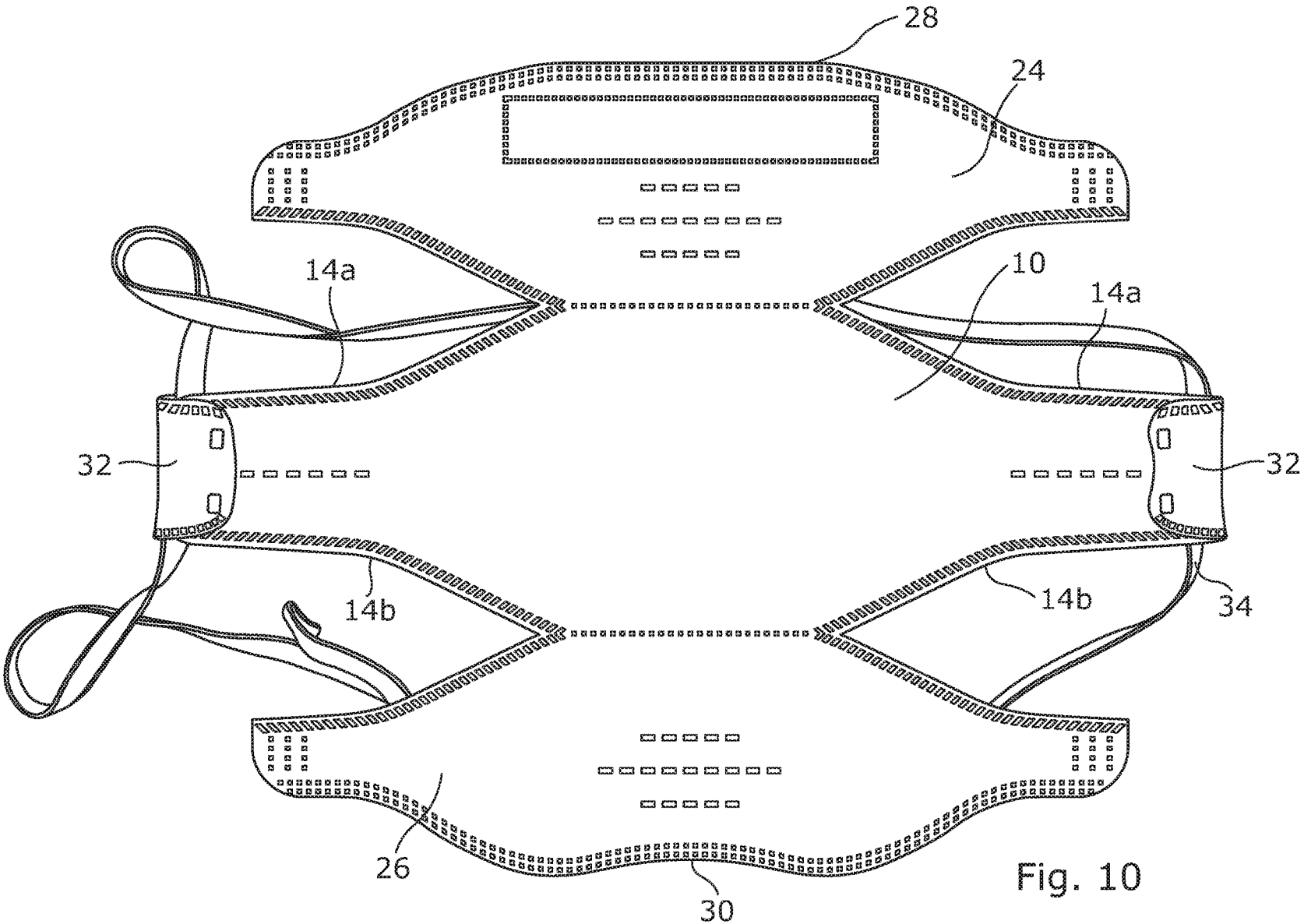
FIG. 10 is a schematic plan view of an opposing second side of the template of FIG. 9.

Referring to FIGS. 9 and 10 of the drawings, a method of manufacturing a personal respiratory device according to the second exemplary embodiment of the present invention will now be described in more detail. However, it is to be understood that a similar method of manufacture can be employed in respect of the device of the first exemplary embodiment, with the only differences being in the shape and configuration of the endoskeleton member and, or course, the additional step of mounting the exhalation device assembly.

As shown in FIGS. 9 and 10 of the drawings, a personal respiratory device according to the second exemplary embodiment of the invention may be manufactured using a 'template', comprising the central panel 10 and the first and second side panels 24, 26, and formed of a flexible filter media material and (optionally) an outer protective layer or coating. No reinforcing layer or scrim is required to be provided in any of the panels.

The first side panel 24 is integrally joined to the central panel 10 at the upper side edge 12*a* thereof, with the tapered edges forming the respective upper edges of the side portions 14 being initially separate. Similarly, the second side panel 26 is integrally joined to the central panel 10 at the lower side edge 12*b* thereof, with the tapered edges forming the respective lower edges of the side portions 14 being initially separate.

The first end edge of each mounting flap 32 is first securely bonded on the inner edge of a respective end edge 11 of the central panel 10 and the second end edge of each mounting flap 32 is folded over the respective end edge 11 (toward the front to the central panel 10), with a portion of the head strap 34 therebetween, and securely bonded to the front of the central panel 10 so as to form a loop within which a respective portion of the head strap is retained.

The elongate cushioning strip 40 is adhered, bonded or otherwise joined on the inner surface of the first side panel 24, adjacent its free edge 28. The endoskeleton member 360 is welded onto the inner surface of the central panel 10, and located substantially centrally thereon, such that each apex of the arm portions 360*b* is located at (or very close to) a respective end edge 11 of the central panel 10, and the distal edge of each rectangular frame portion 360*c* abuts a respective upper or lower side edge 12*a*, 12*b* thereof.

Next, the template is folded at the lower side edge 12*b* of the central panel 10, such that the second side panel 26 lies parallel, and adjacent, to the inner or rear surface of the central panel 10, and the end edges of the second side panel are securely bonded or otherwise joined at the end edges of the central panel 10, with the first end edge of the mounting flap 32 therebetween. Finally, the template is folded at the upper side edge 12*a* of the central panel, such that the first side panel 24 lies parallel, and adjacent, to the inner or rear surface of the central panel 10, and the end edges of the first side panel 24 are securely bonded, or otherwise joined at the end edges of the central panel, with the first end edge of the mounting flap 32 therebetween.

It will be appreciated by a person skilled in the art, from the foregoing description, that modifications and variations can be made to the described embodiments, without departing from the scope of the invention as defined by the appended claims.

The invention claimed is:

1. A fold-flat personal respiratory device comprising:

a generally planar central panel including a layer of filter media and having opposing first and second side edges and first and second end edges;

a first side panel joined to said central panel along said first side edge;

a second side panel joined to said central panel along said second side edge;

the device being manually configurable from a folded configuration in which said side panels are substantially parallel to a planar surface of said central panel and an operational configuration in which said central and first and second side panels form a cup-shaped respiratory chamber;

the device further comprising a rigid or semi-rigid endoskeleton member mounted along the planar surface of said central panel and extending between said first and second side edges and/or said first and second end edges, wherein said endoskeleton member comprises first and second elongate longitudinal arm portions that extend from a central region of the central panel to a position at or adjacent to respective end edges thereof, wherein said first and second elongate longitudinal arm portions each comprise a generally triangular frame member comprising a pair of arms spaced apart at said central region and meeting at an apex opposite said central region, and wherein said endoskeleton member comprises first and second transverse arm portions that extend from a central region of the central panel to respective side edges thereof, wherein said first and second transverse arm portions each comprise a generally square or rectangular frame member having a pair of substantially parallel, spaced-apart end arms and a distal side arm extending therebetween, said end arms extending transversely from said central region such that said side arm is at, or adjacent to, and substantially parallel to, a respective side edge of said central panel, and whereby the endoskeleton member provides an internal frame structure;

wherein said endoskeleton member further comprises a central frame portion comprising a generally square or rectangular frame member, located at said central region of said central panel, and from which said first and second elongate longitudinal arm portions and/or said first and second transverse arm portions extend.

2. The fold-flat respiratory device according to claim 1, wherein said endoskeleton member is formed of semi-rigid plastics material.

3. The fold-flat respiratory device according to claim 1, wherein said apex is rounded.

4. The fold-flat respiratory device according to claim 1, further comprising an exhalation valve assembly mounted within said endoskeleton member, at said central region of said central panel.

5. The fold-flat respiratory device according to claim 1, wherein said central frame portion includes a generally cylindrical frame member mounted or integrated in said central frame portion and configured to receive an exhalation valve assembly.

6. The fold-flat respiratory device according to claim 1, wherein said central frame portion of said endoskeleton member is provided with a reinforcing member that extends between a pair of opposing side edges of the central frame portion.

7. The fold-flat respiratory device according to claim 6, wherein said reinforcing member comprises a pair of reinforcing arms, each extending between a respective pair of opposing side edges of the central frame portion and intersecting at a generally central location within the central frame portion.

8. A method of manufacturing the fold-flat respiratory device according to claim 1, comprising: providing an integrated template comprising said central panel and said first and second side panels; and mounting or adhering said endoskeleton member onto the planar surface of said central panel such that the endoskeleton member extends between said first and second end edges and/or said first and second side edges thereof.

9. A method according to claim 8, wherein said central region comprises a generally square or rectangular shape defining said first and second opposing side edges and a pair of respective end portions extending from said central region, each end portion having tapered opposing side edges and terminating at a respective end edge of said central panel, each side panel being integrally joined to said central panel along a respective side edge thereof and having a pair of tapered end portions, the method further comprising joining, at adjacent edges thereof, respective end portions of said central panel and said side panels to form said cup-shaped respiratory chamber.

10. A method according to claim 8, wherein said endoskeleton member comprises an exhalation valve frame member and the central panel includes a generally central opening, the method further comprising mounting an exhalation valve assembly in said exhalation valve frame member such that the exhalation valve assembly is located within said opening.

11. A method according to claim 8, further comprising joining one or more straps to said central panel, at or adjacent respective end edges thereof.

* * * * *